US009300064B2

(12) United States Patent
Takenaga et al.

(10) Patent No.: US 9,300,064 B2
(45) Date of Patent: Mar. 29, 2016

(54) CONNECTOR

(71) Applicants: JAPAN AVIATION ELECTRONICS INDUSTRY, LIMITED, Tokyo (JP); JAE ELECTRONICS, INC., Irvine, CA (US)

(72) Inventors: Yuichi Takenaga, Tokyo (JP); Kazushi Kamata, Irvine, CA (US)

(73) Assignees: JAPAN AVIATION ELECTRONICS INDUSTRY, LIMITED, Tokyo (JP); JAE ELECTRONICS, INC., Irvine, CA (US)

( * ) Notice: Subject to any disclaimer, the term of this patent is extended or adjusted under 35 U.S.C. 154(b) by 0 days.

(21) Appl. No.: 14/283,732

(22) Filed: May 21, 2014

(65) Prior Publication Data

US 2015/0207248 A1 Jul. 23, 2015

Related U.S. Application Data

(60) Provisional application No. 61/928,537, filed on Jan. 17, 2014.

(51) Int. Cl.
*H01R 12/00* (2006.01)
*H01R 12/71* (2011.01)
(Continued)

(52) U.S. Cl.
CPC ..... *H01R 12/716* (2013.01); *H01R 12/73* (2013.01); *H01R 13/6582* (2013.01); *H01R 13/2435* (2013.01); *H01R 13/6594* (2013.01)

(58) Field of Classification Search
CPC .... H01R 12/71; H01R 23/68; H01R 12/7029; H01R 12/716; H01R 13/627; H01R 13/11
USPC ..... 439/350, 660, 135, 940, 74
See application file for complete search history.

(56) References Cited

U.S. PATENT DOCUMENTS 5,545,051 A * 8/1996 Summers ..... H01R 12/716 439/350
5,626,482 A * 5/1997 Chan ..... H01R 12/52 439/353

(Continued)

FOREIGN PATENT DOCUMENTS

JP 2008-218095 9/2008
JP 2012-252785 12/2012
JP 2012252785 A * 12/2012

OTHER PUBLICATIONS

Office Action issued in Taiwan Counterpart Patent Appl. No. 103143066, dated Sep. 14, 2015 , along with an English translation thereof.

(Continued)

*Primary Examiner* — Abdullah Riyami
*Assistant Examiner* — Nader J Alhawamdeh
(74) *Attorney, Agent, or Firm* — Greenblum & Bernstein, P.L.C.

(57) ABSTRACT

A connector includes a housing, contacts arranged and held in the housing, and a shell attached around the housing. The shell is made from a plate and includes an elongated part extending along a sidewall of the housing and a spring piece adapted to contact a ground contact of a mating connector. The spring piece includes a base part protruded from the elongated part in the direction perpendicular to the direction in which the elongated part extends and bent so that its front end is positioned inward from the sidewall, an intermediate part extended from the front end of the base part in the direction in which the elongated part extends, and a contact tip extended from a front end of the intermediate part in the direction perpendicular to the direction in which the elongated part extends. The intermediate part is spaced away from an inner surface of the sidewall and the contact tip is positioned further inward from the inner surface than the intermediate part and a front end of the contact tip is directed to the side from which the mating connector is inserted. The spring piece of the shell can be made pliant even though the profile of the connector is low. Thus, connector profile reduction can be achieved.

10 Claims, 12 Drawing Sheets

(51) Int. Cl.

| | |
|---|---|
| ***H01R 12/73*** | (2011.01) |
| ***H01R 13/6582*** | (2011.01) |
| *H01R 13/24* | (2006.01) |
| *H01R 13/6594* | (2011.01) |

(56) References Cited

U.S. PATENT DOCUMENTS

| | | | | |
|---|---|---|---|---|
| 6,116,949 | A * | 9/2000 | Costello | H01R 13/6485 439/509 |
| 6,855,004 | B2 * | 2/2005 | Soh | H01L 23/60 439/41 |
| 6,955,546 | B1 * | 10/2005 | Huang | H01R 13/5213 439/135 |
| 7,074,085 | B2 * | 7/2006 | Chen | H01R 23/6873 439/108 |
| 7,232,317 | B2 * | 6/2007 | Ookura | H01R 13/506 439/660 |
| 7,367,816 | B2 * | 5/2008 | Liu | H01R 13/26 439/74 |
| 7,748,994 | B1 * | 7/2010 | Peng | H01R 13/6315 439/660 |
| 7,922,499 | B2 * | 4/2011 | Liao | H01R 12/714 439/660 |
| 8,272,881 | B2 * | 9/2012 | Miyazaki | H01R 13/20 439/345 |
| 8,292,630 | B1 * | 10/2012 | Bobuk | H01R 12/73 439/136 |
| 8,292,635 | B2 * | 10/2012 | Little | H01R 12/7029 439/570 |
| 8,678,667 | B2 | 3/2014 | Koreeda et al. | |
| 8,708,579 | B2 | 4/2014 | Shiratori et al. | |
| 8,721,190 | B2 | 5/2014 | Koreeda et al. | |
| 8,992,233 | B2 * | 3/2015 | Miyazaki | H01R 12/707 439/74 |
| 2004/0018756 | A1 * | 1/2004 | Pan | H01R 13/6271 439/74 |
| 2008/0214051 | A1 | 9/2008 | Obikane | |
| 2010/0130068 | A1 * | 5/2010 | Peng | H01R 13/2457 439/660 |
| 2010/0190383 | A1 * | 7/2010 | Yamada | H01R 12/716 439/680 |
| 2011/0165797 | A1 * | 7/2011 | Takeuchi | H01R 12/716 439/660 |
| 2011/0250800 | A1 * | 10/2011 | Guo | H01R 12/716 439/660 |
| 2013/0012074 | A1 * | 1/2013 | Mashiyama | H01R 12/73 439/660 |
| 2013/0023162 | A1 * | 1/2013 | Harlan | H01R 12/73 439/660 |
| 2014/0227910 | A1 * | 8/2014 | Tanaka | H01R 12/7052 439/626 |

OTHER PUBLICATIONS

Office Action issued in Korea Counterpart Patent Appl. No. 10-2014-0174767, dated Dec. 8, 2015.

* cited by examiner

CONNECTOR

CLAIM FOR PRIORITY

This application claims the priority benefit of U.S. provisional application 61/928,537, filed Jan. 17, 2014, the contents of which is expressly incorporated by reference herein in its entirety.

TECHNICAL FIELD

The present invention relates to a connector that provides electrical connection.

BACKGROUND ART

Connectors for electrically interconnecting circuit boards in a face-to-face relation (board-to-board connectors) are traditionally being used. FIGS. 1 and 2 illustrate a configuration described in Japanese Patent Application Laid Open No. 2012-252785 (published on Dec. 20, 2012, hereinafter referred to as Literature 1), which is an example of such conventional connectors. Illustrated in FIGS. 1 and 2 are a connector (receptacle connector) 10 designed to be mounted on a circuit board, not depicted, and a mating connector (plug connector) 20 designed to be mounted on another circuit board, not depicted, and to be mated with the connector 10. FIG. 2 illustrates a cross-sectional structure of the connector 10 and the mating connector 20 mated together.

The connector 10 includes a housing 11, contacts 12*a*, 12*b* held by the housing 11, and a pair of shells 13*a*, 13*b* which are provided on sidewall parts of the housing 11 so as to surround the housing 11 and the contacts 12*a*, 12*b*, and are designed to be grounded to a circuit board, not depicted.

The mating connector 20 includes a main body 21, a pair of mating fitting parts 22*a*, 22*b* protruding from the lower surface of the main body 21 in parallel with each other, a plurality of mating contacts 23*a*, 23*b* which are provided along the length of the mating fitting parts 22*a*, 22*b* at a predetermined pitch and are designed to be connected to the contacts 12*a*, 12*b* of the connector 10, and ground terminals 24*a*, 24*b* which are provided at both ends of the mating fitting parts 22*a*, 22*b* and are designed to be connected to the shells 13*a*, 13*b*.

The housing 11 of the connector 10 has its length along the pitch direction of the contacts 12*a*, 12*b* and includes a pair of opposed first sidewall parts 14*a*, 14*b* and a pair of opposed second sidewall parts 14*c*, 14*d* which join the ends of the pair of first sidewall parts 14*a*, 14*b*.

Grooves 15*a*, 15*b* in which the mating fitting parts 22*a*, 22*b* of the mating connector 20 are to be inserted are provided in the upper surface of the housing 11. Contact insertion holes 16*a*, 16*b* are provided across the grooves 15*a*, 15*b* at a predetermined pitch along the length of the housing 11. The ends of the grooves 15*a*, 15*b* are joined by joining grooves 17*a*, 17*b* and a block-like raised part 18 is formed in the center.

As illustrated in FIG. 3, the shell 13*a* includes a joining main part 31 disposed along the second sidewall part 14*c* of the housing 11, a short-side main part 32 disposed along the first sidewall part 14*b*, and a long-side main part 33 disposed along the first sidewall part 14*a*. The joining main part 31 has a bent part 34 and a shell ground part 35 which protrudes from the bent part 34 toward the inner side of the shell 13*a* and is designed to contact the ground terminal 24*a* of the mating connector 20 is provided.

A short-side latch part 32*a* is provided at the short-side main part 32 for engagement and securing of the shell 13*a* to the housing 11 and connection with a ground terminal on a circuit board. An end latch part 33*a* and a long-side latch part 33*c* are provided at the long-side main part 33 for connection with a ground terminal on the circuit board. A long-side latch part 33*b* is further provided at the long-side main part 33 for engagement and securing of the shell 13*a* to the housing. Note that the shell 13*b* has the same shape as the shell 13*a*.

The connector 10 is assembled by pressing the contacts 12*a*, 12*b* into the contact insertion holes 16*a*, 16*b*, respectively, of the housing 11 and engaging and securing the above-mentioned latches of the shells 13*a*, 13*b* to press-fit parts provided in the sidewall parts of the housing 11.

The mating of the connector 10 with the mating connector 20 is accomplished by inserting the mating fitting parts 22*a*, 22*b* of the mating connector 20 into the grooves 15*a*, 15*b*, respectively, of the connector 10. As a result, the mating contacts 23*a*, 23*b* of the mating connector 20 are pinched by the contacts 12*a*, 12*b*, respectively, of the connector 10, thereby the connectors 10 and 20 are interconnected.

As illustrated in FIG. 2, the ground terminals 24*a*, 24*b* of the mating connector 20, on the other hand, are inserted in the joining grooves 17*a*, 17*b* of the connector 10 and are brought into contact with the shell ground parts 35 of the shells 13*a*, 13*b* and are thereby grounded.

In this way, the mating connector 20 is mated and electrically connected with the connector 10.

FIG. 4 illustrates another exemplary shape of a shell described in Literature 1. The shell 13*c* illustrated in FIG. 4 has a shell ground part 35 provided on the inner side of a long-side main part 33.

There is a demand for size reduction of connectors of this type (board-to-board connectors) in order to save mounting space and, with the decrease in spacing between circuit boards to interconnect, there is also a growing demand for reduction in the profile of connectors.

In these circumstances, connectors (receptacle connectors) such as the connector 10 described above that include shells on which spring pieces as ground parts that contact ground terminals of a mating connector are formed require the spring pieces to be highly pliant, reliable and durable. However, spring pieces have reached the limits of thickness and width. Furthermore, increasing the length of spring pieces inhibits reductions of size and profile of connectors. Therefore, it has been difficult to provide highly pliant, reliable and durable spring pieces.

SUMMARY OF THE INVENTION

In light of these problems, an object of the present invention is to provide a connector including a shell having a spring piece, wherein the connector is small in size and profile and the spring piece is pliant, reliable and durable.

According to the present invention, a connector includes a housing, contacts arranged and held in the housing and a shell attached around the housing. The shell is made from a plate and includes an elongated part extending along a sidewall of the housing and a spring piece adapted to contact a ground contact of a mating connector. The spring piece includes a base part protruded from the elongated part in the direction perpendicular to the direction in which the elongated part extends and bent so that its front end is positioned inward from the sidewall, an intermediate part extended from the front end of the base part in the direction in which the elongated part extends, and a contact tip extended from a front end of the intermediate part in the direction perpendicular to the direction in which the elongated part extends. The intermediate part is spaced away from an inner surface of the sidewall and the contact tip is positioned further inward from the inner surface than the intermediate part and a front end of the contact tip is directed to the side from which the mating connector is inserted.

The present invention enables a spring piece of a shell that contacts a ground contact of a mating connector to be made pliant, reliable and durable even though the profile of the connector is low. Thus, reduction in size and profile of connector can be achieved.

DETAILED DESCRIPTION OF THE EMBODIMENTS

Figure 1:
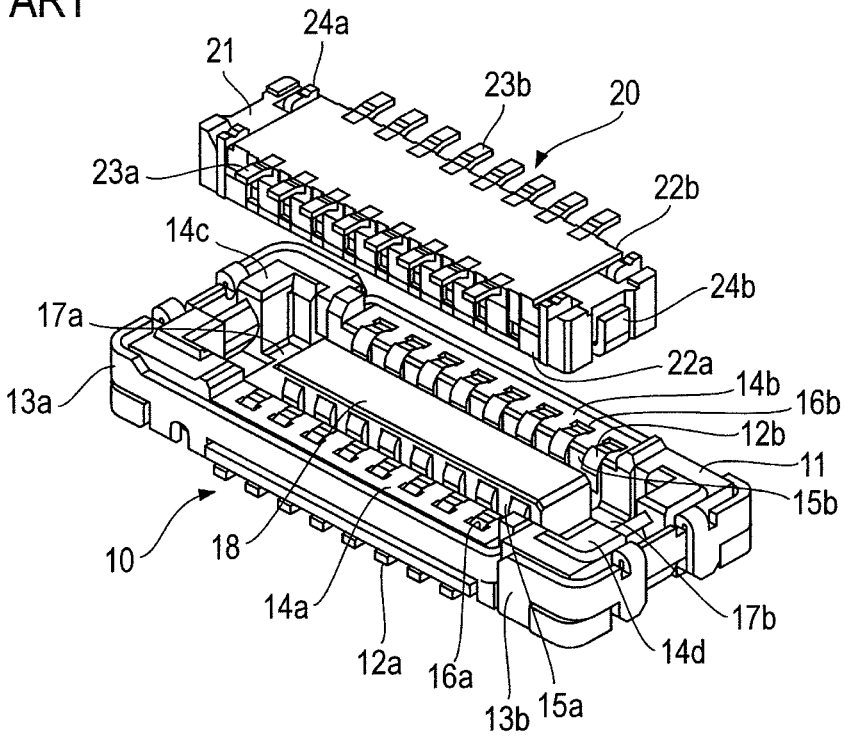
FIG. 1 PRIOR ART
FIG. 1 is a perspective view illustrating exemplary conventional connectors that electrically interconnect circuit boards.
Figure 2:
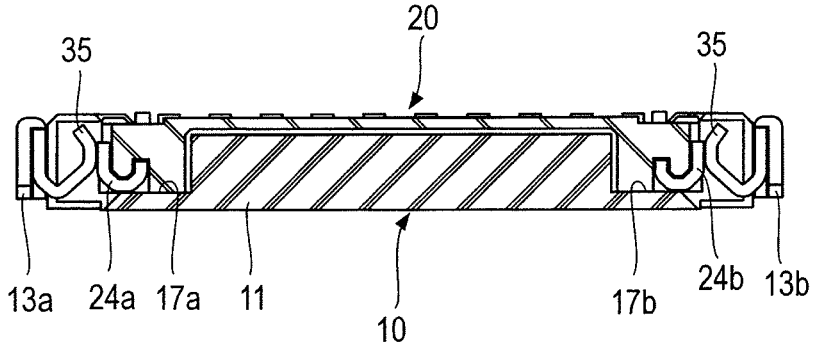
FIG. 2 PRIOR ART
FIG. 2 is a cross-sectional view illustrating the connectors illustrated in FIG. 1 mated together.
Figure 3:
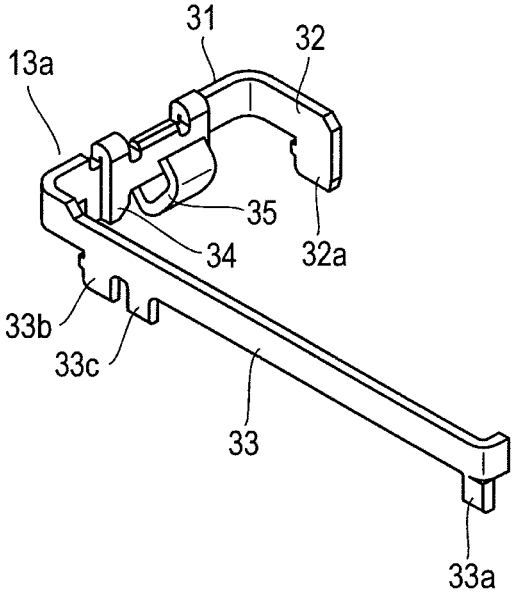
FIG. 3 PRIOR ART
FIG. 3 is a perspective view of a shell in FIG. 1.
Figure 4:
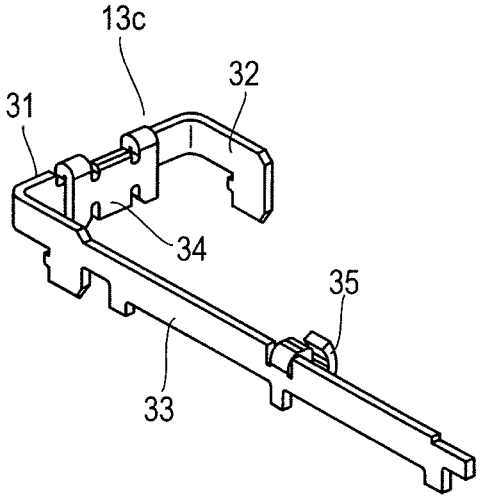
FIG. 4 PRIOR ART
FIG. 4 is a perspective view illustrating another exemplary shape of a conventional shell.
Figure 5A:
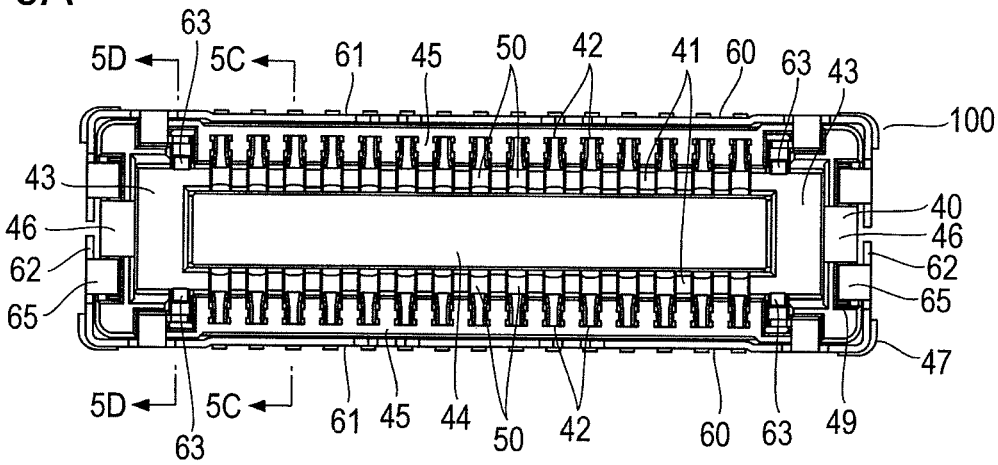
FIG. 5A is a plan view illustrating one embodiment of a connector according to the present invention.
Figure 5B:
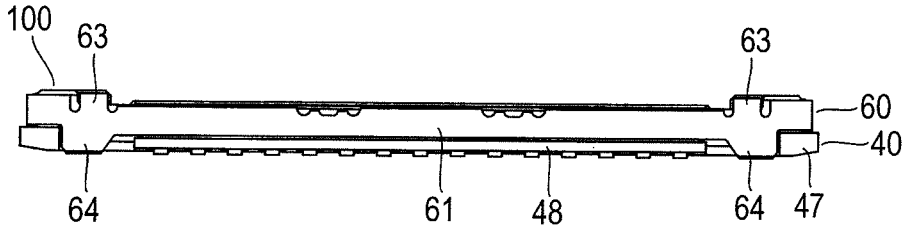
FIG. 5B is a front view illustrating one embodiment of a connector according to the present invention.
Figure 5C:
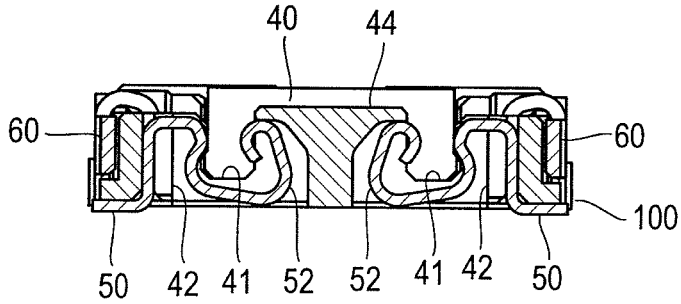
FIG. 5C is an enlarged cross-sectional view of FIG. 5A taken along line 5C-5C.
Figure 5D:
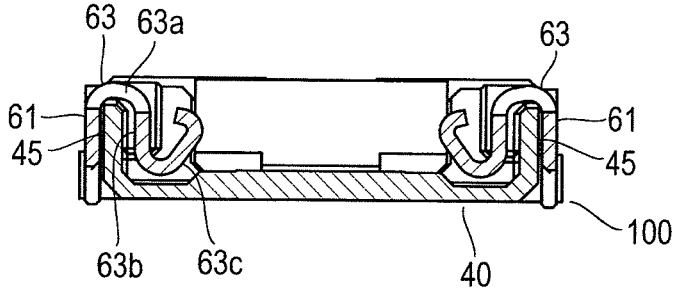
FIG. 5D is an enlarged cross-sectional view of FIG. 5A taken along line 5D-5D.
Figure 6A:
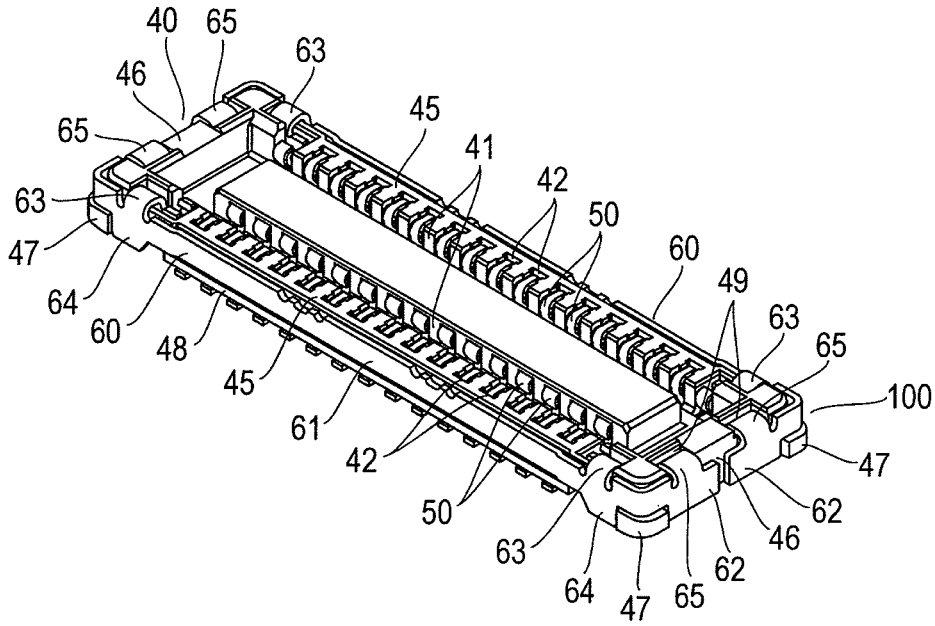
FIG. 6A is a perspective view of the connector illustrated in FIG. 5A as viewed from above.
Figure 6B:
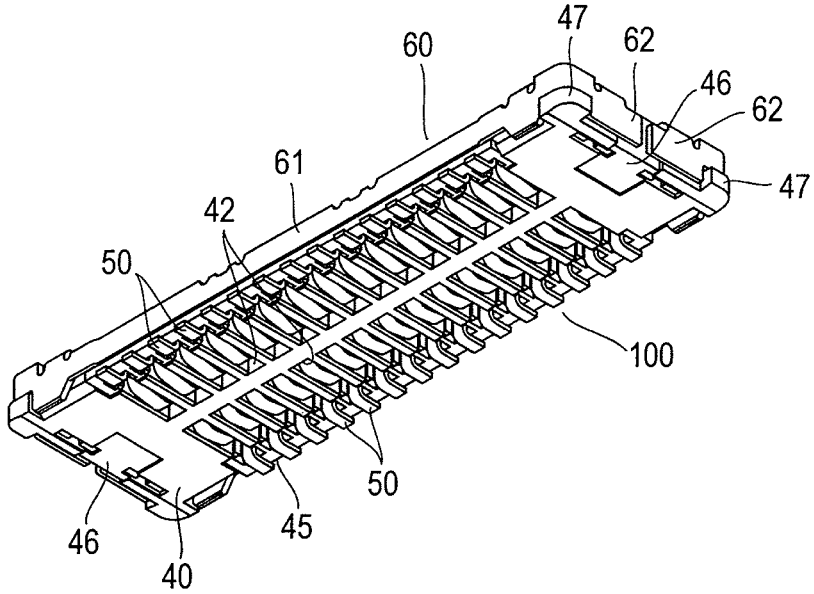
FIG. 6B is a perspective view of the connector illustrated in FIG. 5A as viewed from below.
Figure 7A:
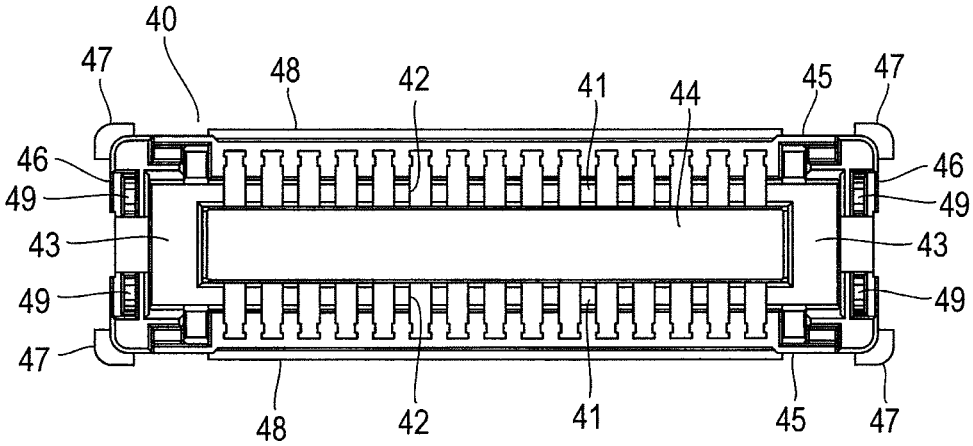
FIG. 7A is a plan view of a housing in FIG. 5A.
Figure 7B:
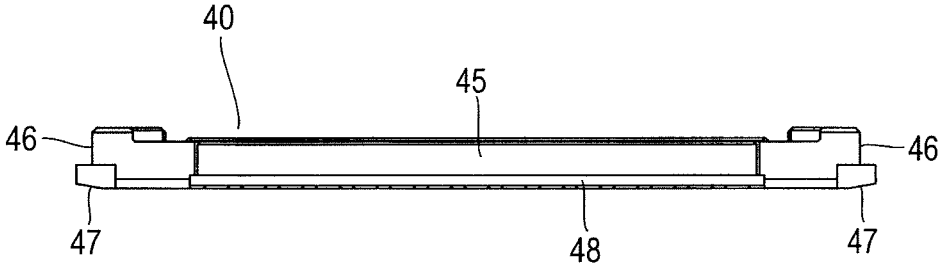
FIG. 7B is a front view of the housing in FIG. 5A.
Figure 8A:
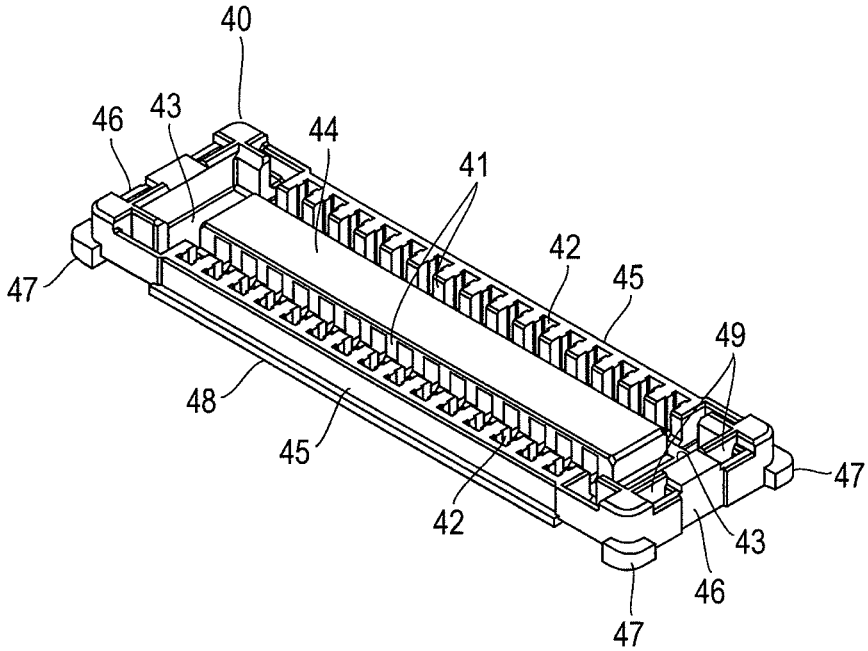
FIG. 8A is a perspective view of the housing illustrated in FIG. 7A as viewed from above.
Figure 8B:
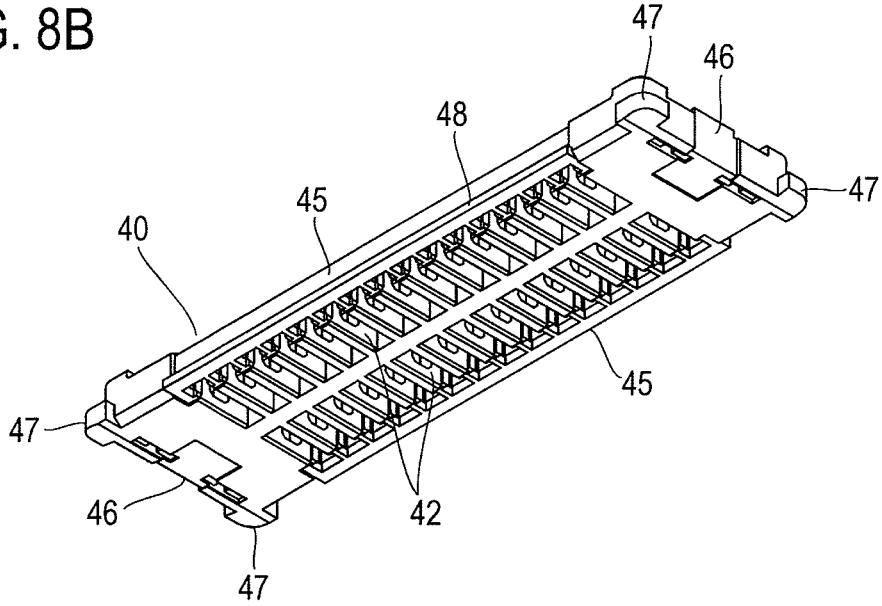
FIG. 8B is a perspective view of the housing illustrated in FIG. 7A as viewed from below.

Embodiments of the present invention will be described below.

FIGS. 5A to 5D and 6A and 6B illustrate one embodiment of a connector according to the present invention. The connector 100 is a connector used for electrically interconnecting circuit boards face to face (board-to-board connector) and acts as a receptacle connector.

The connector 100 includes a housing 40, a large number of contacts 50 arranged and held in the housing 40, and a pair of shells 60 attached around the housing 40. Components of the connector 100 will be described first.

As illustrated in FIGS. 7A, 7B, 8A and 8B, the housing 40 is a thick plate having a rectangular outside shape and is made of resin. Pair of grooves 41 are formed in the upper surface of the housing 40 along the long sides of the rectangle and contact insertion holes 42 are formed across the grooves 41 at a predetermined pitch in an array in the direction in which the grooves 41 extend. The ends of one of the grooves 41 are joined to the ends of the other groove 41 by grooves 43 formed along the short sides of the rectangle. A block-shaped raised part 44 is provided in the central area surrounded by the grooves 41, 43. The housing 40 including these grooves 41, 43 has sidewalls around the grooves 41, 43. The sidewalls include a pair of sidewalls 45 positioned along the pair of long sides of the rectangle and a pair of sidewalls 46 positioned along the pair of short sides of the rectangle.

Corner frames 47 are formed at the four corners of the outside surfaces of the sidewalls 45, 46 of the housing 40, one at each corner, and side frames 48 are formed at the outside surfaces of the sidewalls 45 corresponding to the portions where the array of contact insertion holes 42 are formed. A predetermined gap is provided between the side frames 48 and the corner frames 47. Note that two recesses 49 are formed in the upper surface of each of the pair of sidewalls 46.

Figure 9A:
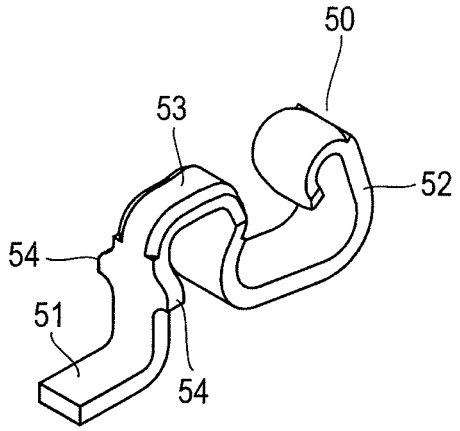
FIG. 9A is a perspective view of the contact in FIG. 5A.
Figure 9B:
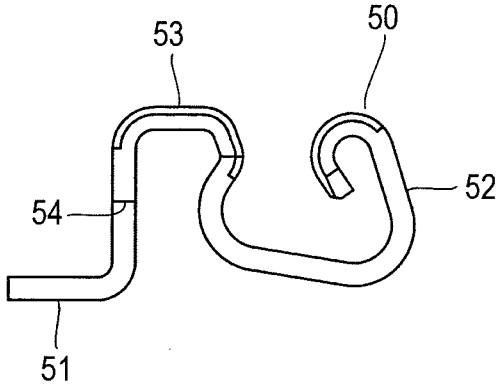
FIG. 9B is a front view of the contact in FIG. 5A.

A contact 50 has a shape as illustrated in FIGS. 9A and 9B and includes an L-shaped external connection part 51, a substantially U-shaped contact part 52, and a joining part 53 joining one end of the external connection part 51 to one end of the contact part 52. The other end (front end) of the contact part 52 is bent so as to be positioned inside the shape of U. Note that hooks 54 are protruded outward at the ends of the width of the external connection part 51, nearer the joining part 53.

A structure of a shell 60 will now be described with reference to FIGS. 10A to 10C and 11A to 11C.

The shell 60 is made by cutting a metal plate into a required shape and bending the resulting plate and has an elongated part 61 disposed along the sidewall 45 of the housing 40 and extension parts 62 extended from both ends of the elongated part 61, bent at a right angle in the same direction. The extension parts 62 are disposed along a half of the pair of sidewalls 46 of the housing 40.

Spring pieces 63 are protruded each from each of the ends of the elongated part 61 in the direction in which the elongated part 61 extends and board connection parts 64 are protruded, one at each end.

Each of the spring pieces 63 includes a base part 63*a* which is protruded upward from the elongated part 61 in the direction perpendicular to the direction in which the elongated part 61 extends and is bent downward so that its front end is positioned inward from the shell 60 (the side in which the extension part 62 is bent), an intermediate part 63*b* extended from the front end of the base part 63*a* in the direction in which the elongated part 61 extends, and a contact tip 63*c* extended from the front end of the intermediate part 63*b* in the direction perpendicular to the direction in which the elongated part 61 extends.

The contact tip 63*c* is protruded downward from the front end of the intermediate part 63*b* and then bent upward and is provided so as to be positioned further inward from the shell 60 than the intermediate part 61. Note that the front end of the contact tip 63*c* is bent toward the elongated part 61.

Figure 10A:
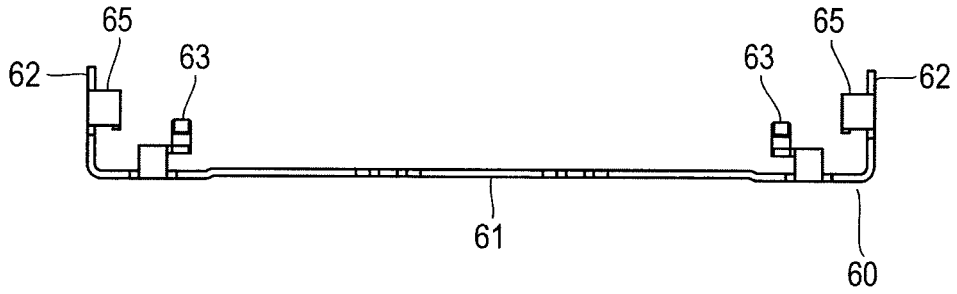
FIG. 10A is a plan view of a shell in FIG. 5A.
Figure 10B:
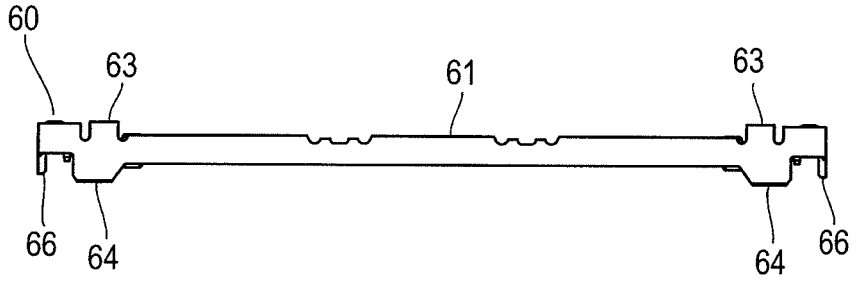
FIG. 10B is a front view of the shell in FIG. 5A.
Figure 10C:
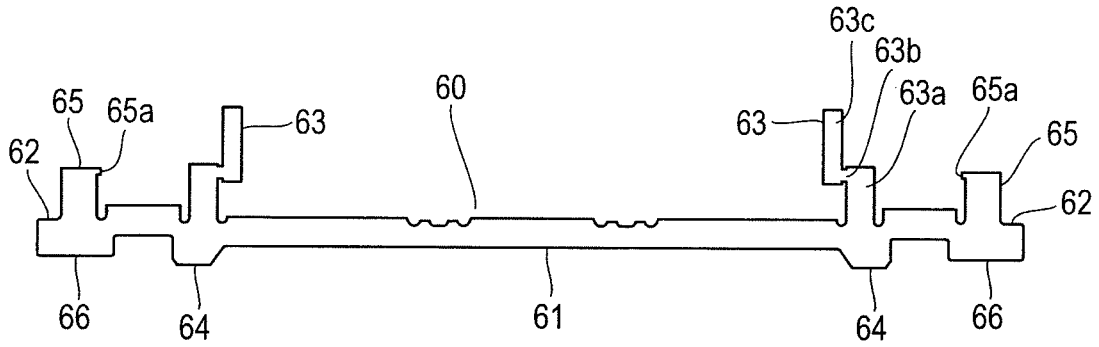
FIG. 10C is a blank of the shell in FIG. 5A.
Figure 11A:
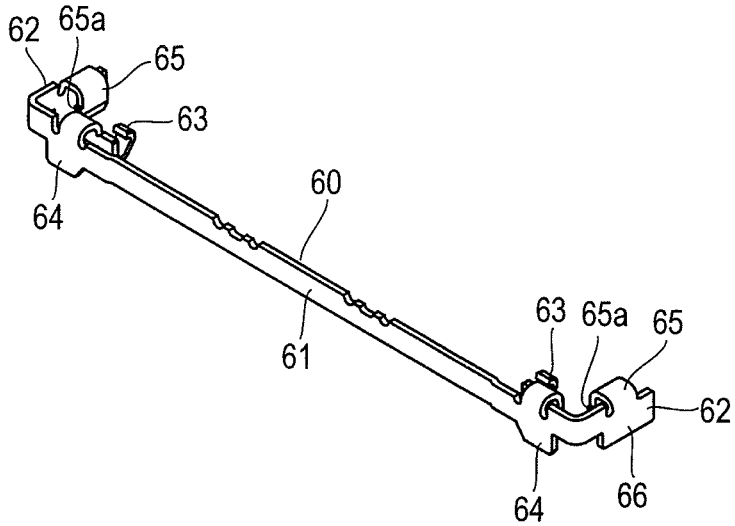
FIG. 11A is a perspective view of the shell illustrated in FIG. 10A as viewed from the front.
Figure 11B:
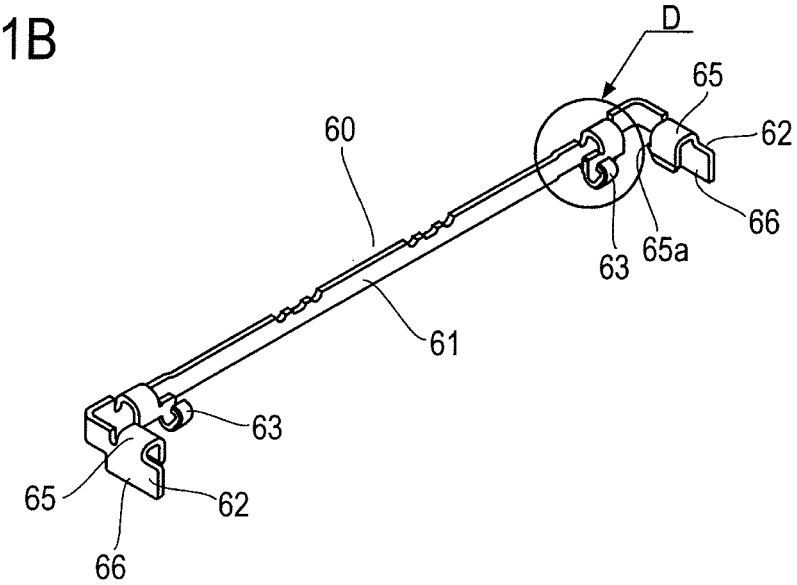
FIG. 11B is a perspective view of the shell illustrated in FIG. 10A as viewed from the rear.
Figure 11C:
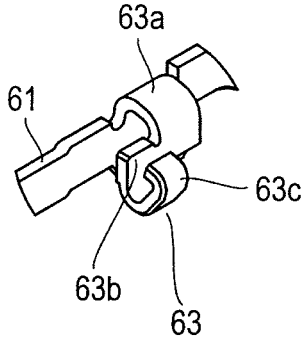
FIG. 11C is an enlarged view of portion D in FIG. 11B.

The spring piece 63 shaped as described above has a crank-like shape before being bent (i.e. a blank) as illustrated in FIG. 10C.

The board connection part 64 is protruded downward from the elongated part 61, as opposed to the spring piece 63, and is used for connection with a ground trace on a circuit board on which the connector 100 is surface-mounted.

On the other hand, a latch 65 is protruded from each extension part 62. The latch 65 is protruded upward from the extension part 62 and then bent downward so that the front end is positioned inward from the shell 60, and a hook 65*a* is protruded on one side of the width of the front end. Note that each extension part 62 has a protrusion 66 protruding downward and the joining part joining the elongated part 61 to the extension part 62, positioned between the protrusion 66 and the board connection part 64 is raised upward.

The connector 100 is assembled by pressing the contacts 50 and the shells 60 into the housing 40.

The contacts 50 are attached to the housing 40 by pressing the contacts 50 into the contact insertion holes 42 in the housing 40 from below the lower surface of the housing 40. The contact part 52 of each contact 50 is placed in the groove 41 of the housing 40 and the front end of the external connection part 51 slightly protrudes from the sidewall 45.

Each shell 60 is attached to the housing 40 by pressing the pair of latches 65 into the recesses 49 provided in the sidewall 46 of the housing 40. The lower surface of the elongated part 61 abuts against the side frame 48 and the lower surface of the raised joining part between the elongated part 61 and the extension part 62 abuts against the corner frame 47. The board connection part 64 are each inserted and positioned in the gap between the side frame 48 and the corner frame 47.

The base part 63*a* of each spring piece 63 lies across the upper surface of the sidewall 45 and the front end of the base part 63*a* is positioned inward from the sidewall 45. The intermediate part 63*b* is spaced away from the inner surface of the sidewall 45 and the contact tip 63*c* is positioned further inward from the inner surface of the sidewall 45 than the intermediate part 63*b*, the front end of the contact tip 63*c* is directed upward, i.e. in the direction in which a mating connector is to be inserted.

The pair of shells 60 are attached to the housing 40, so that the housing 40 is enclosed by the pair of shells 60.

The contacts 50 and the shells 60 are attached in this way to complete the connector 100 illustrated in FIGS. 5A to 5D and 6A and 6B.

Figure 12A:
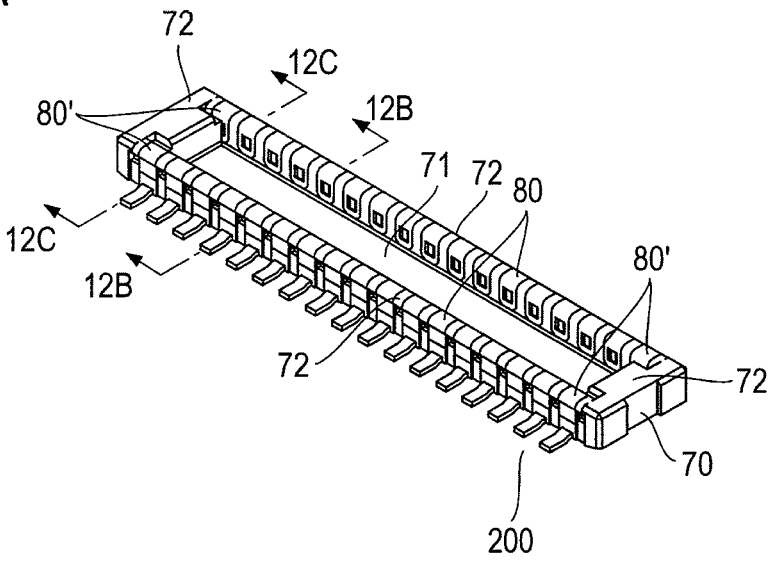
FIG. 12A is a perspective view illustrating a mating connector adapted to be mated with the connector illustrated in FIG. 5A.
Figure 12B:
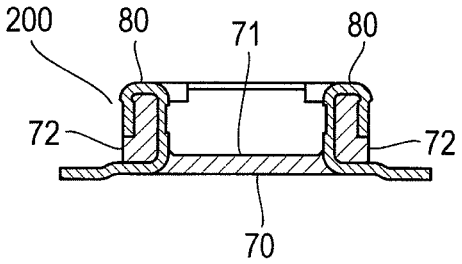
FIG. 12B is an enlarged cross-sectional view of FIG. 12A taken along line 12B-12B.
Figure 12C:
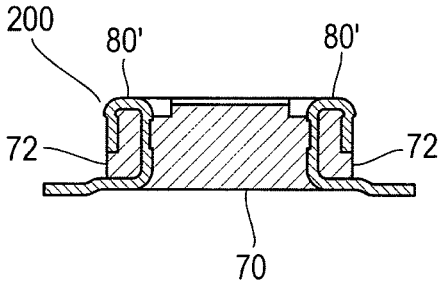
FIG. 12C is an enlarged cross-sectional view of FIG. 12A taken along line 12C-12C.

FIGS. 12A to 12C illustrate a mating connector (plug connector) 200 adapted to be mated with the connector 100. The mating connector 200 includes a housing 70 which is a thick plate having a rectangular shape and a large number of contacts 80 arranged and held in the housing 70. The housing 70 is made of resin and the contacts 80 are disposed in the housing 70 by insert-molding.

A recess 71 which is adapted to engage with the raised part 44 of the connector 100 is formed in the upper surface of the housing 70. The recess 71 is framed with a fitting part 72 to be inserted and fit into the grooves 41, 43 of the connector 100. The contacts 80 are arranged along a pair of long sides of the fitting part 72 at a predetermined pitch so as to wrap around the fitting part 72 and are exposed at the outer surface, the inner surface and the upper surface of the fitting part 72. One end of each of the contacts 80 is laterally protruded from the lower surface of the housing 70 for external connection. Note that in this example the contacts 80' positioned at both ends of the pair of long sides of the fitting part 72 are ground contacts that will contact the spring pieces 63 of the shells 60 of the connector 100.

Figure 13A:
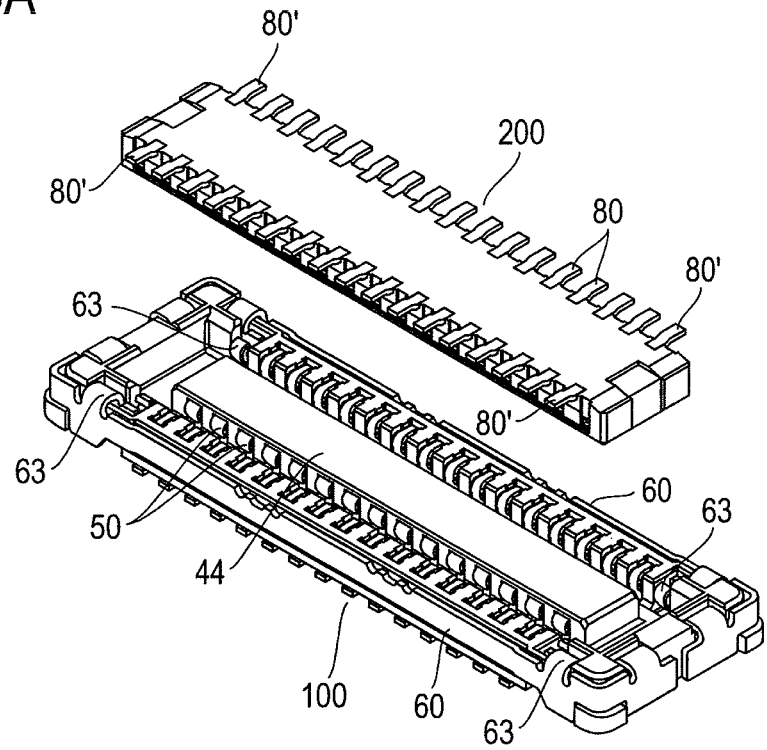
FIG. 13A is a perspective view illustrating the connector illustrated in FIG. 5A and the mating connector illustrated in FIG. 12A before being mated.
Figure 13B:
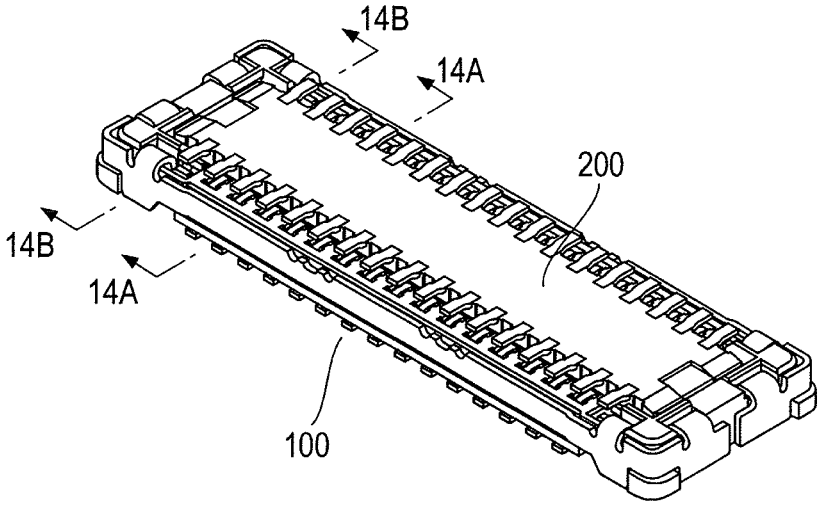
FIG. 13B is a perspective view illustrating the connector illustrated in FIG. 5A and the mating connector illustrated in FIG. 12A after being mated.

FIG. 13A illustrates the connector 100 surface-mounted on a circuit board (not depicted) and the mating connector 200 surface-mounted on another circuit board (not depicted) are positioned face to face in order to mate the connectors 100 and 200 with each other. FIG. 13B illustrates the connector 100 and the mating connector 200 mated with each other. FIGS. 15A and 15B illustrate cross sections of the connector 100 and the mating connector 200 mated with each other.

Figure 14A:
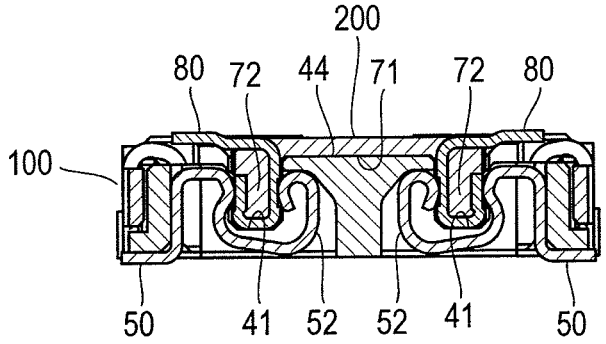
FIG. 14A is an enlarged cross-sectional view of FIG. 13B taken along line 14A-14A.

Mating of the connector 100 and the mating connector 200 is accomplished by inserting the fitting part 72 of the mating connector 200 into the grooves 41, 43 of the connector 100. This causes the contacts 80 of the mating connector 200 to be pinched by the contact parts 52 of the contact 50 of the connector 100 as illustrated in FIG. 14A to contact the contact parts 52, thus the contacts 80 and the contact parts 52 are connected with each other.

Figure 14B:
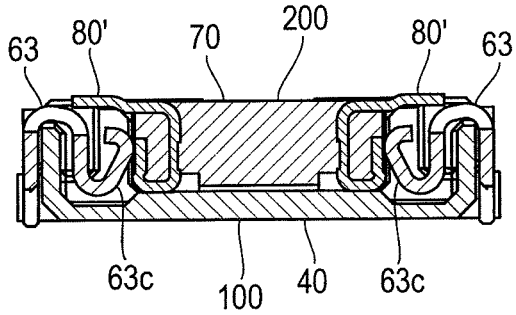
FIG. 14B is an enlarged cross-sectional view of FIG. 13B taken along line 14B-14B.

On the other hand, the ground contacts 80' of the mating connector 200 contact the contact tips 63*c* of the spring pieces 63 of the shells 60 of the connector 100 as illustrated in FIG. 14B, thereby the ground contacts 80' and the contact tips 63*c* are connected with each other.

In this way, the connector 100 and the mating connector 200 are electrically interconnected.

While the shells 60 of the connector 100 described above have spring pieces 63 adapted to contact the ground contacts 80' of the mating connector 200 as in the conventional connectors, the spring pieces 63 each have an intermediate part 63*b* extended in the direction in which the elongated part 61 of each shell 60 extends, i.e. the longitudinal direction perpendicular to the height direction of the sidewall 45 of the housing 40. The intermediate part 63*b* is spaced away from the inner surface of the sidewall 45 and is elastically deformable. The provision of the intermediate part 63*b* enables the length of the spring piece 63, in this example, to be significantly increased. In addition, the base part 63*a* of the spring piece 63 also contributes to the length of the spring piece 63 because the base part 63*a*, which is shaped so as to lie across the upper surface of the sidewall 45, has a large bend radius and functions as a spring.

Thus, the configuration of the connector 100 having the configuration described above enables the spring pieces 63 of the shells 60 to be made pliant, reliable and durable even though the profile of the connector 100 is low. Thus, reduction in size and profile of connector can be achieved.

Note that the spring piece 63 is configured so that the intermediate part 63*b* prevents the front end of the contact tip 63*c* of the spring piece 63 from making contact with the other parts of the spring piece 63 when the spring piece 63 contacts a ground contact 80' of the mating connector 200 and deforms. Accordingly, for example when the spring piece 63 is forced to significantly deform due to variations in the dimensions or processing variations of the spring pieces 63 or variations in conditions of mating with a mating connector 200, the spring pieces 63 appropriately deform, rather than undergoing an unexpected deformation.

Figure 15:
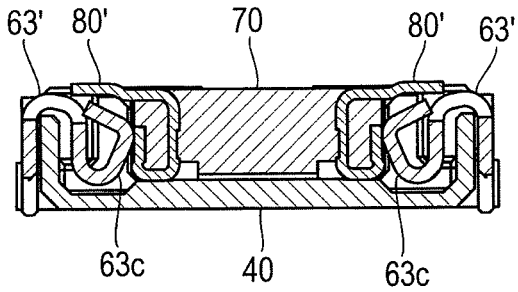
FIG. 15 is a cross-sectional view illustrating mating of a connector with a mating connector where there are variations in the dimensions of spring pieces of a shell.

FIG. 15 illustrates an example of such conditions where spring pieces 63' that have a longer front end portion (bent portion) of the contact tip 63*c* bent toward the inner surface of the sidewall 45 due to a dimension variation are in contact with ground contacts 80'. It can be seen that the front ends of the contact tips 63*c* of the spring pieces 63' appropriately deform without making contact with the other parts of the spring pieces 63'.

What is claimed is:

1. A connector comprising:

a housing;

contacts arranged and held in the housing; and a shell attached around the housing;

wherein the shell comprises a plate and includes an elongated part extending along a sidewall of the housing and a spring piece configured to contact a ground contact of a mating connector;

the spring piece comprises a base part that protrudes from the elongated part in a direction perpendicular to the direction in which the elongated part extends and includes a bend such that a front end of the base part is positioned inwardly of the sidewall, an intermediate part that extends from the front end of the base part in the direction in which the elongated part extends, and a contact tip that extends from a front end of the intermediate part in the direction perpendicular to the direction in which the elongated part extends;

the intermediate part is spaced from an inner surface of the sidewall; and the contact tip is positioned further inward from the inner surface than the intermediate part and a front end of the contact tip is directed to the side from which the mating connector is inserted.

2. The connector according to claim 1, wherein the spring piece has a crank-like configuration in a planar state.

3. The connector according to claim 1, wherein the front end of the contact tip includes a bend so as to extend toward the inner surface.

4. The connector according to claim 2, wherein the front end of the contact tip includes a bend so as to extend toward the inner surface.

5. The connector according to claim 3, wherein the connector is configured to prevent the front end of the contact tip from making contact with other parts of the spring piece when the spring piece contacts a ground contact of the mating connector and deforms.

6. The connector according to claim 4, wherein the connector is configured to prevent the front end of the contact tip from making contact with other parts of the spring piece when the spring piece contacts a ground contact of the mating connector and deforms.

7. The connector according to any one of claims 1 to 6, wherein the spring piece is provided at each of the ends of the length of the elongated part.

8. The connector according to any one of claims 1 to 6, wherein the housing has a rectangular outside shape;

the shell includes extension parts each extending from each end of the elongated part, the extension parts including a bend that extends at a right angle in the same direction; and the housing is enclosed by a pair of the shells.

9. The connector according to any one of claims 1 to 6, wherein the connector is configured to be surface-mounted on a circuit board; and a board connection part configured to be connected to a ground trace on the circuit board is provided in the shell.

10. The connector according to claim 1, the intermediate part of the spring piece extending in a direction transverse to the direction in which the base part protrudes, and the contact tip extending in a direction transverse to the extending direction of the intermediate part.

* * * * *